US010737189B2

(12) United States Patent
Halliburton

(10) Patent No.: US 10,737,189 B2
(45) Date of Patent: Aug. 11, 2020

(54) BALLOON

(71) Applicant: Seatriever International Holdings Limited, Lostock Gralam, Northwich Cheshire (GB)

(72) Inventor: James Halliburton, Lostock Gralam (GB)

(73) Assignee: Seatriever International Holdings Limited (GB)

( * ) Notice: Subject to any disclaimer, the term of this patent is extended or adjusted under 35 U.S.C. 154(b) by 369 days.

(21) Appl. No.: 15/551,225

(22) PCT Filed: Feb. 24, 2016

(86) PCT No.: PCT/GB2016/050468
§ 371 (c)(1),
(2) Date: Aug. 16, 2017

(87) PCT Pub. No.: WO2016/135483
PCT Pub. Date: Sep. 1, 2016

(65) Prior Publication Data

US 2018/0028930 A1 Feb. 1, 2018

(30) Foreign Application Priority Data

Feb. 27, 2015 (GB) ..... 1503342.6
Dec. 4, 2015 (GB) ..... 1521457.0

(51) Int. Cl.
*A63H 27/10* (2006.01)
*G09F 19/00* (2006.01)
(Continued)

(52) U.S. Cl.
CPC ..... *A63H 27/10* (2013.01); *B42D 15/00* (2013.01); *B44F 1/06* (2013.01); *B44F 1/10* (2013.01);
(Continued)

(58) Field of Classification Search
CPC A63H 27/10; A63H 2027/1058; G09F 13/08; G09F 2013/0463; G09F 2013/0468
See application file for complete search history.

(56) References Cited

U.S. PATENT DOCUMENTS 2,816,378 A 12/1957 Levinson
3,592,157 A * 7/1971 Schwartz ..... F21V 3/023 340/815.74
(Continued)

FOREIGN PATENT DOCUMENTS

CN 1242856 1/2000
DE 10356721 7/2005
(Continued)

*Primary Examiner* — Gary C Hoge
(74) *Attorney, Agent, or Firm* — Burns & Levinson, LLP; George N. Chaclas

(57) ABSTRACT

A balloon comprises a printed display. The printed display comprises: a printed image layer; a blocking layer provided behind selected portions of the printed image layer; and a diffusion layer provided behind at least those portions of the printed image layer not backed by the blocking layer. The blocking layer acts to block illumination of portions of the printed image layer, such that the printed display provides a different appearance when lit primarily from inside the balloon to when lit primarily from outside the balloon.

26 Claims, 4 Drawing Sheets

Figure 1A:
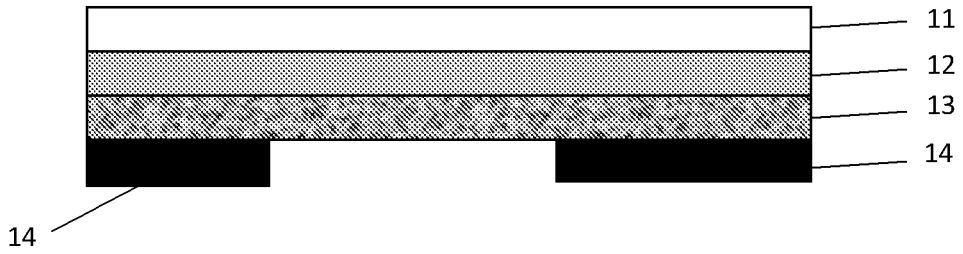

(51) Int. Cl.

| | |
|---|---|
| ***G09F 13/08*** | (2006.01) |
| ***B44F 1/10*** | (2006.01) |
| ***B44F 1/06*** | (2006.01) |
| ***B42D 15/00*** | (2006.01) |
| *G09F 13/04* | (2006.01) |

(52) U.S. Cl.
CPC ..... *G09F 13/08* (2013.01); *G09F 19/00* (2013.01); *A63H 2027/1058* (2013.01); *G09F 2013/0463* (2013.01); *G09F 2013/0468* (2013.01)

(56) References Cited

U.S. PATENT DOCUMENTS

| | | | | | |
|---|---|---|---|---|---|
| 5,075,830 | A * | 12/1991 | Perez | A63H 27/10 | 362/190 |
| 5,075,930 | A | 12/1991 | Carey | | |
| 5,117,344 | A * | 5/1992 | Perez | A63H 27/10 | 362/190 |
| 5,807,157 | A * | 9/1998 | Penjuke | A63H 27/10 | 362/262 |
| 5,947,581 | A * | 9/1999 | Schrimmer | A63H 27/10 | 362/189 |
| 5,975,725 | A | 11/1999 | Ireland-Stacy | | |
| 6,106,135 | A * | 8/2000 | Zingale | A63H 27/10 | 362/186 |
| 6,602,105 | B1 * | 8/2003 | Sussell | A63H 27/10 | 362/253 |
| 6,767,609 | B2 | 7/2004 | Aeling | | |
| 7,413,494 | B2 * | 8/2008 | Huang | G09F 15/0025 | 362/565 |
| 7,416,776 | B2 | 8/2008 | Emslander | | |
| 7,611,396 | B2 * | 11/2009 | Schnuckle | A63H 27/10 | 348/744 |
| 7,674,152 | B2 * | 3/2010 | Anderson | A63H 27/10 | 446/220 |
| 7,874,705 | B2 | 1/2011 | Kenney | | |
| 9,303,862 | B1 * | 4/2016 | Rubinstein | A63H 33/22 | |
| 2004/0127138 | A1 * | 7/2004 | Huang | A63H 27/10 | 446/220 |
| 2004/0174718 | A1 * | 9/2004 | Ohlund | B64B 1/50 | 362/565 |
| 2006/0039138 | A1 * | 2/2006 | Oxborrow | A63H 27/10 | 362/189 |
| 2006/0141898 | A1 * | 6/2006 | Petell | A63H 27/10 | 446/220 |
| 2007/0117493 | A1 * | 5/2007 | Wu | A63H 27/10 | 446/220 |
| 2014/0268632 | A1 | 9/2014 | Yang | | |
| 2017/0114994 | A1 * | 4/2017 | Kosted | F21V 23/0407 | |

FOREIGN PATENT DOCUMENTS

| | | |
|---|---|---|
| EP | 1985914 | 10/2008 |
| GB | 2472785 | 2/2011 |
| JP | 5-121175 | 5/1993 |
| JP | 05139019 | 6/1993 |
| JP | 09171361 | 6/1997 |
| JP | 2007010950 | 1/2007 |
| JP | 2010198010 | 9/2010 |
| JP | 2013502257 | 1/2013 |
| JP | 2014191337 | 10/2017 |
| WO | 98/30998 | 7/1998 |
| WO | 1998/30998 | 7/1998 |
| WO | 1999/40987 | 8/1999 |
| WO | 2007041971 | 4/2007 |
| WO | 2011/021022 | 2/2011 |

* cited by examiner

BALLOON

CROSS-REFERENCE TO RELATED APPLICATIONS

This application is the U.S. national phase entry under 35 U.S.C. § 371 of International Application No. PCT/GB2016/050468, filed Feb. 24, 2016, entitled BALLOON, which in turn claims priority to and benefit of GB Application No. 1503342.6, filed Feb. 27, 2015; and GB Application No. 1521457.0, filed Dec. 4, 2015, the contents of which are incorporated herein by reference in their entirety for all purposes.

TECHNICAL FIELD OF THE INVENTION

The present invention relates to balloons and in particular to balloons comprising printed displays that are adapted to provide a differing appearance under different lighting conditions.

BACKGROUND TO THE INVENTION

A balloon is a flexible bag that can be inflated with a gas. Balloons typically have a printed display on the outside surface of the bag for decorative purposes.

These printed displays usually comprise an image printed on a panel or other substrate. When the balloon is lit from the outside, the printed image can be viewed. In some cases, the panel or substrate may be inherently coloured and the presence or absence of printing over part of the panel or substrate may add to the visual effect.

In other circumstances, where the substrate or panel is transparent or translucent, the display panel or substrate can be lit from inside the balloon. This can provide for efficient illumination in low light settings. One example of such a display would be an image printed on a balloon formed from a transparent or translucent plastic. In this case, a shadow image layer may be printed on the inside surface of the display so that a negative image of the shadow image layer is projected on to the outside surface. Nevertheless, balloons having known displays all provide a substantially similar appearance when illuminated from inside or outside the balloon.

It is an object of the present invention to provide a balloon comprising a printed display that is adapted to provide a different appearance when lit under different lighting conditions.

SUMMARY OF THE INVENTION

According to a first aspect of the present invention, there is provided a balloon comprising a printed display, the printed display comprising: a printed image layer; a blocking layer provided behind selected portions of the printed image layer; and a diffusion layer provided behind at least those portions of the printed image layer not backed by the blocking layer.

The blocking layer acts to block illumination of portions of the printed image layer, such that the printed display provides a different appearance when lit primarily from inside the balloon to when lit primarily from outside the balloon.

In the printed display of a balloon of the type above, the blocking layer acts to block illumination of portions of the printed image layer from behind and the diffusion layer acts to diffusely reflect illumination from in front of the display that passes through the printed image layer. Under front lighting conditions, when the balloon is lit primarily from its outside, the images provided in the printed image layer are thus clearly visible. The diffusion layer also acts to diffuse illumination from behind the printed image layer. The portions of the printed image layer in front of the blocking layer receive substantially no illumination under backlighting conditions, when the balloon is lit primarily from its inside, and thus will appear substantially black or dark under such conditions, whilst the remaining portions of the printed image are highlighted under backlighting conditions. As the portions of the printed image layer backed by the blocking layer need not correspond with the images provided on the printed image layer, the balloon's display may provide a markedly different appearance under backlighting as opposed to front lighting.

As a further example, two balloons having displays provided with identical printed image layers but different blocking layers would have an identical external appearance under front illumination but a significantly different appearance under backlighting.

Accordingly, the printed display provides multiple printed layers arranged so that the blocking layer alters the external appearance of the printed image layer when primarily backlit from inside of the balloon, compared to the external appearance of the printed image display when primarily frontlit from outside of the balloon. In contrast, with known displays a shadow layer may be printed on the inside surface of a display formed from a translucent or transparent plastic. When the display is lit from behind the shadow layer, a negative image of the shadow layer is projected on to the outside surface of the plastic.

The printed display may comprise a substrate upon which one or more of the layers are printed. The substrate may be substantially transparent or translucent as required or desired. In embodiments where the substrate is translucent, the substrate may comprise the diffusion layer.

The substrate may be a plastic. In particular, the substrate may comprise a plastic film. One example of a suitable plastic film is BoPET (Biaxially-oriented polyethylene terephthalate), commonly sold under the brand name MYLAR. Other examples of suitable plastic films may include polyethylene or a laminate of nylon and polyethylene.

In some embodiments, the substrate may comprise multiple layers. The substrate layers can be laminated directly to one another. In alternative embodiments, the printed image layer, diffusion layer and/or the blocking layer may be provided on different substrate layers or between substrate layers.

The printed image layer may be provided on the front side or the rear side of the substrate. In many instances, it is beneficial if the printed image layer is provided on the rear side of the substrate as the substrate will protect the printed image layer from external contact damage. If the printed image layer is provided on the front side of the substrate, the diffusion layer and/or the blocking layer may be provided on either the front side or the rear side of the substrate The printed image layer may comprise one or more layers of ink. The printed image layer may comprise a single ink or may comprise multiple different coloured inks. Where the printed image layer comprises multiple inks, the printed image layer may be printed according to any suitable colour model. In particular, the printed image layer may be printed according to a CMYK (cyan, magenta, yellow, and key (black)) colour model. The printed image layer may be printed fulltone or halftone as required or desired.

In a further alternative, the printed image layer may comprise a translucent layer formed from separate adjacent areas of differing optical properties. In particular, such a printed image layer may comprise areas containing, dyed with or infused with materials of differing optical properties.

The diffusion layer may comprise one or more layers of ink. In particular, the diffusion layer may comprise one or more layers of white or substantially white ink. In this manner, the diffusion layer can diffusely reflect front illumination that passes through the printed image layer and can diffuse rear illumination before it passes through the printed image layer.

The blocking layer may comprise one or more layers of dark, black or substantially black ink. In some embodiments, the blocking layer may comprise a layer of metallic foil or other opaque material. In some embodiments, there may be two or more blocking layers. In such cases, each blocking layer may be adapted to be opaque to light of specific wavelengths. This can enable an image to look different depending upon the colour of rear illumination.

In some embodiments, the printed display may also comprise an additional diffusion layer provided behind the blocking layer. The additional diffusion layer can alone, or in combination with further reflective surfaces, help to ensure relatively even illumination of the full rear surface of the printed display in the event that a discrete illumination source is used. The additional diffusion layer may comprise one or more layers of white or substantially white ink. In an alternative embodiment, the additional diffusion layer may comprise a partly transmissive metallic foil.

According to a second aspect of the present invention there is provided a balloon according to the first aspect of the present invention, further comprising an illumination source that is operable to illuminate the inside of the balloon.

In this way, the balloon is provided with its own at least substantially internal illumination source for backlighting the printed image display from inside of the balloon. This arrangement is therefore self-contained and portable.

The balloon of the second aspect of the present invention may incorporate any or all of the features of the first aspect of the present invention, as desired or as appropriate.

The illumination source may comprise one or more suitable lamps, including but not limited to one or more light emitting diode(s) (LED). The illumination source may be provided with a power supply, including but not limited to: a mains connection, at least one battery, or an energy scavenging means. The energy scavenging means may be any suitable device including but not limited to a photovoltaic cell.

The illumination source may comprise any one or more of: a single monochrome illumination source; multiple different coloured monochrome illumination sources; and a substantially white illumination source. The illumination source may be operable to provide any one or more of: substantially steady illumination, smoothly varying illumination, or intermittent illumination.

The illumination source may be operable in response to an illumination controller. The illumination controller may comprise a switch. Additionally or alternatively, the illumination controller may comprise a processing unit operable to control the operation of the illumination source in response to specified control signals. The control signals may be generated by any one or more of: a communication receiving unit operable to receive control signals from external devices; a timer unit; one or more sensing units operable to sense local parameters including but not limited to: ambient light levels, temperature, air pressure, moisture, ambient noise levels or the like.

The printed display may comprise all or part of the balloon. The balloon may comprise a latex balloon or a non-latex balloon. Preferably, the balloon comprises a non-latex balloon having a body and a stem comprising, in combination: a first balloon sheet having an interior surface and a periphery; a second balloon sheet bonded to the periphery of the interior surface of the first balloon sheet so as to define the body and the stem; and an illumination source located in or adjacent the stem of the balloon; and wherein the first balloon sheet and/or the second balloon sheet comprises a printed display according to the first aspect of the present invention. Preferably, said balloon may comprise a self-sealing valve provided within the stem.

The illumination source controller in such a balloon may comprise a displaceable actuator located in or adjacent the stem of the balloon. In one embodiment, the displaceable actuator comprises a removable tab initially located between said illumination source and the power supply, removal of which serves to activate the illumination source by connection to its power supply. In such embodiments, the first balloon sheet may be provided with an aperture in the stem permitting access to the valve inlet and the second balloon sheet may be provided with an aperture for projection there through of a portion of the removable tab. Preferably, the removable tab is configured to have an outer end region of enlarged width and a second region of enlarged width at a spacing from the enlarged outer end region. In alternative embodiments, the displaceable actuator comprises a switch initially located between said illumination source and the power supply, displacement of which serves to activate the illumination source by connection to its power source.

According to a third aspect of the present invention there is provided a method of manufacturing a printed display for a balloon according to the first or second aspects of the present invention, the method comprising the steps of: printing the image layer, diffusion layer and blocking layer in turn on a substrate such that the blocking layer is provided behind selected portions of the printed image layer and the diffusion layer is provided behind at least those portions of the printed image layer not backed by the blocking layer.

The method of the third aspect of the present invention may incorporate any or all features of the first or second aspects of the present invention as desired or as appropriate.

Where appropriate, the printed image layer, blocking layer and/or diffusion layer can be formed as steps within a single printing process. Alternatively, it is possible for the printed image layer, blocking layer and/or diffusion layer to be formed by separate successive processes.

The method may include the step of printing the blocking layer over the full area of the display and subsequently removing areas of the printed blocking layer. Removal of areas of the blocking layer may be achieved by any suitable process including, but not limited to: chemical, abrasive or adhesive based processes. In particular, this method might be applied where the blocking layer comprises a metallic foil and/or where the blocking layer is provided on a different side of the substrate than the other layers.

According to a fourth aspect of the present invention there is provided a method of manufacturing a printed display for a balloon according to the first or second aspects of the present invention, the method comprising the steps of: printing the image layer, diffusion layer and blocking layer in turn on different layers of substrate; and bonding the layers of substrate together such that the blocking layer is provided behind selected portions of the printed image layer and the diffusion layer is provided behind at least those portions of the image layer not backed by the blocking layer.

The method of the fourth aspect of the present invention may incorporate any or all features of the first or second aspects of the present invention as desired or as appropriate.

Where appropriate, the printed image layer, blocking layer and/or diffusion layer can be formed as steps within a single printing process. Alternatively, it is possible for the printed image layer, blocking layer and/or diffusion layer to be formed by separate successive processes.

The method may include the step of printing the blocking layer over the full area of the display and subsequently removing areas of the printed blocking layer. Removal of areas of the blocking layer may be achieved by any suitable process including, but not limited to: chemical, abrasive or adhesive based processes. In particular, this method might be applied where the blocking layer comprises a metallic foil and/or where the blocking layer is provided on a different layer of substrate than the other layers.

DETAILED DESCRIPTION OF THE INVENTION

Figure 1B:
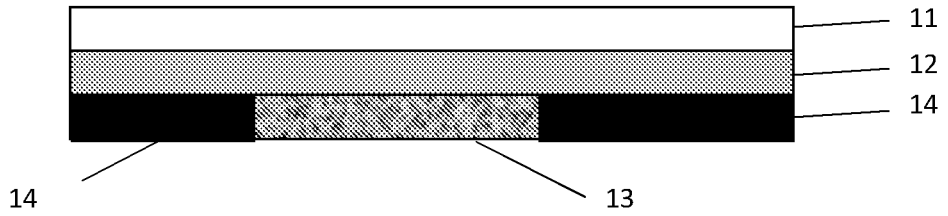
Figure 1C:
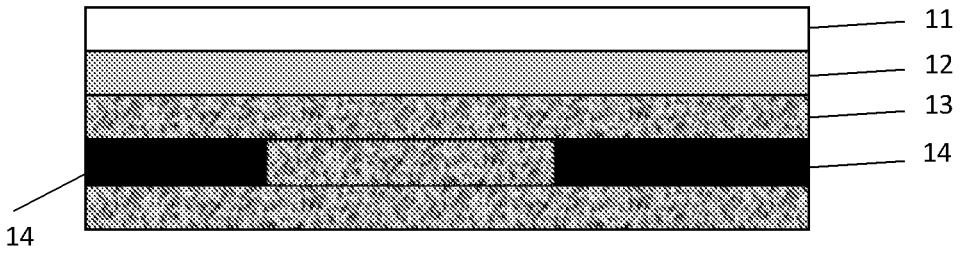
Figure 1D:
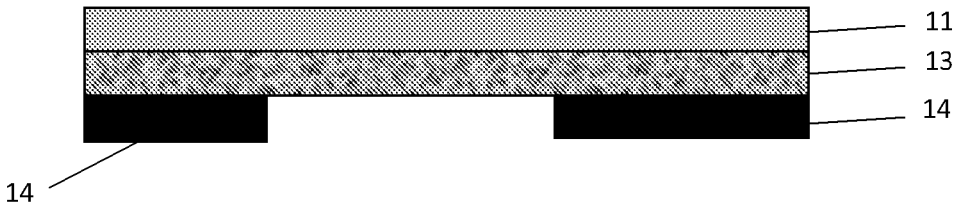
Figure 1E:
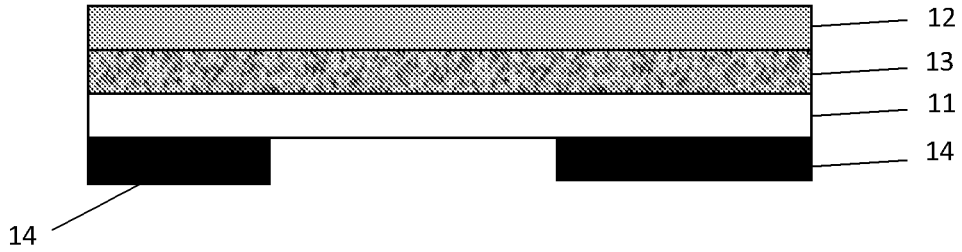
Figure 1F:
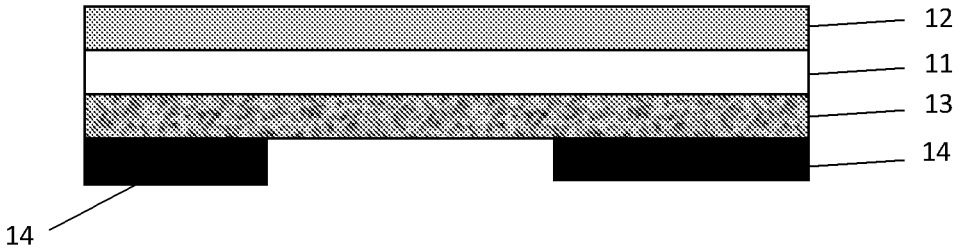
Figure 1G:
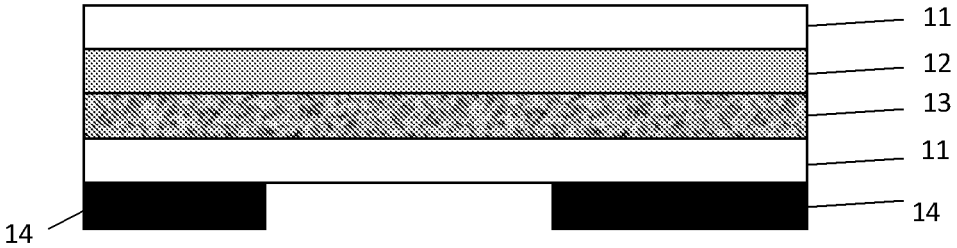
Figure 2A:
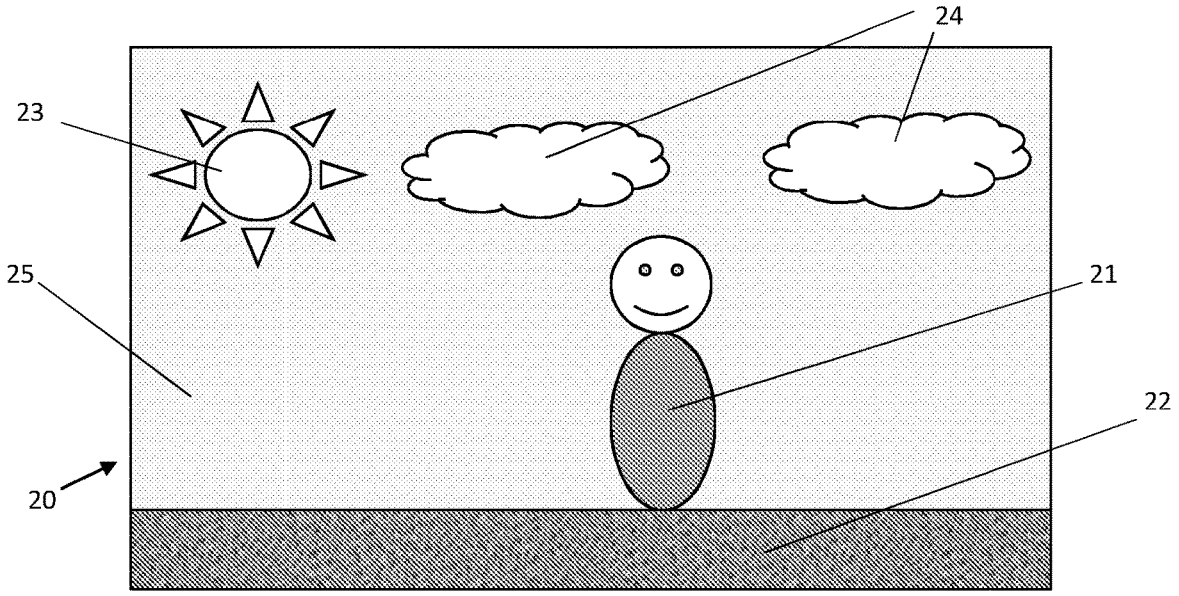
Figure 2B:
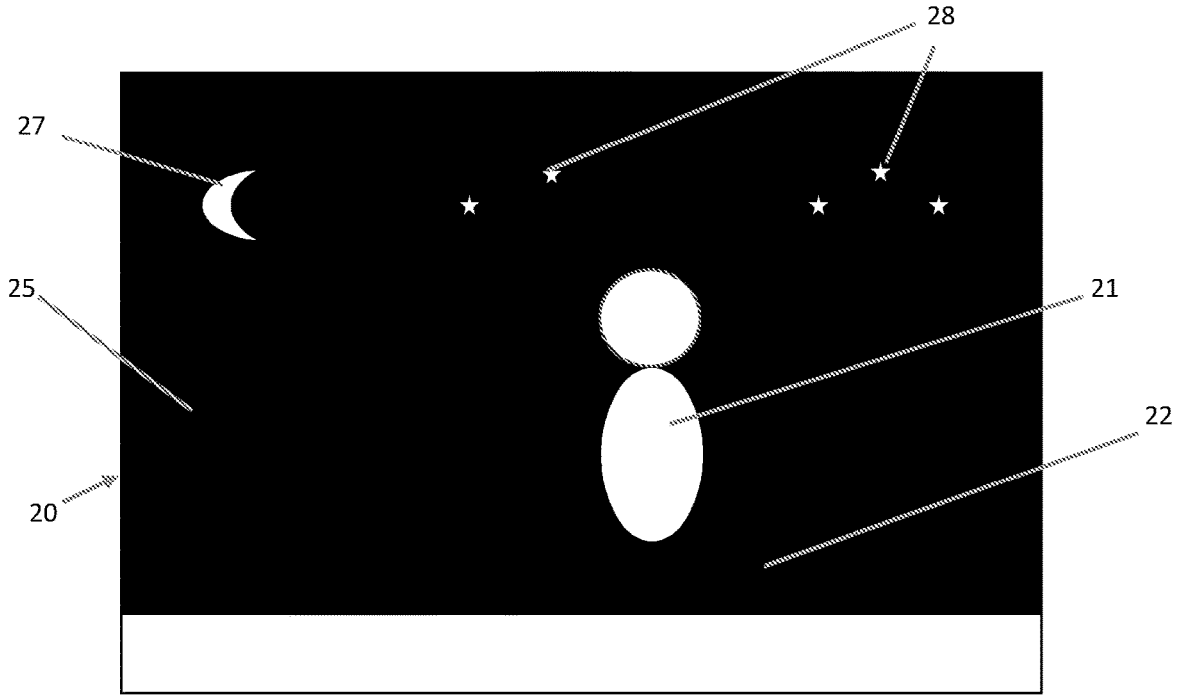

In order that the invention may be more clearly understood an embodiment/embodiments thereof will now be described, by way of example only, with reference to the accompanying drawings, of which:

FIG. 1*a* is a schematic cross-section of a first embodiment of a printed display for a balloon according to the present invention;

FIG. 1*b* is a schematic cross-section of a first embodiment of a printed display for a balloon according to the present invention;

FIG. 1*c* is a schematic cross-section of a first embodiment of a printed display for a balloon according to the present invention;

FIG. 1*d* is a schematic cross-section of a first embodiment of a printed display for a balloon according to the present invention;

FIG. 1*e* is a schematic cross-section of a first embodiment of a printed display for a balloon according to the present invention;

FIG. 1*f* is a schematic cross-section of a first embodiment of a printed display for a balloon according to the present invention;

FIG. 1*g* is a schematic cross-section of a first embodiment of a printed display for a balloon according to the present invention;

FIG. 2*a* shows an exemplary printed display for a balloon according to the present invention under front lighting;

FIG. 2*b* shows the extent of the blocking layer of the exemplary printed display of FIG. 2*a;*

Figure 2C:
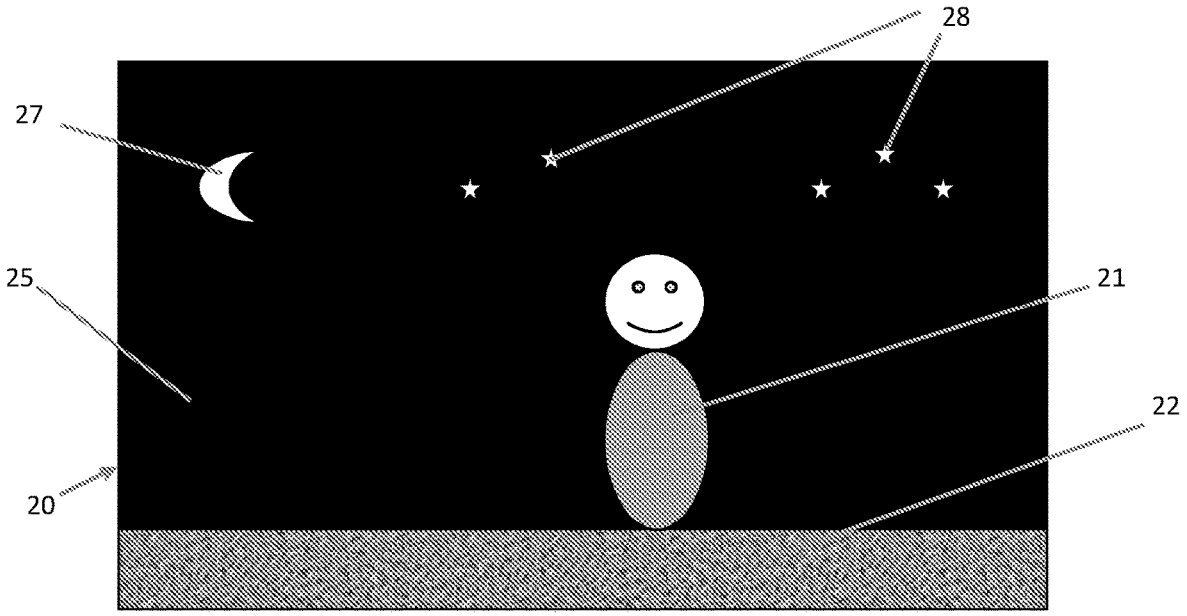
Figure 3:
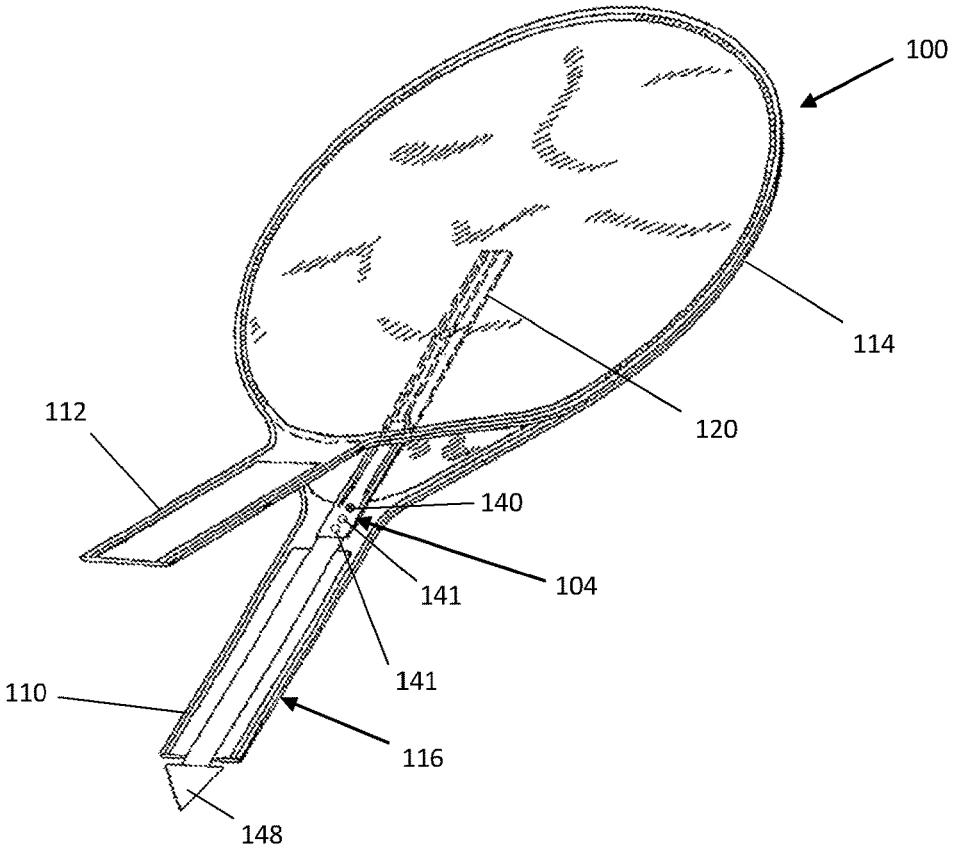

FIG. 2*c* shows the exemplary printed display of FIGS. 2*a* and 2*b* under back lighting;

FIG. 3 shows a balloon according to the present invention; and

Referring to FIG. 1*a*, a first embodiment of a printed display 10 for a balloon according to the present invention comprises a substantially transparent substrate 11. On the rear side of the substrate are a printed image layer 12, a diffusion layer 13 and a blocking layer 14. The substrate 11 is typically a plastic or a plastic film.

The printed image layer 12 comprises a printed image 20 formed from one or more layers of ink. This image 20 is visible when the display 10 is lit primarily from the front.

The diffusion layer 13 comprises one or more layers of white or light coloured ink. The diffusion layer 13 acts to provided diffuse reflection of light that penetrates the image layer 12 from in front of the display 10. The diffusion layer 13 also provides for diffuse transmission of light incident on the display 10 from behind.

The blocking layer 14 is substantially opaque and thereby acts to block light from being transmitted through the display 10 from behind. The blocking layer 14 may be formed of one or more layers of dark, black or substantially black ink. Alternatively, in some embodiments, the blocking layer 14 may comprise a metallised layer.

The blocking layer 14 does not cover the entire extent of the display 10, being provided behind selected portions of the printed image layer 12 only. In this manner, portions of the printed image layer 12 in front of the blocking layer 14 receive substantially no illumination when back lit and thus will appear substantially black or dark under such conditions, whilst the remaining portions of the printed image layer 12 will receive illumination and are highlighted under backlighting conditions. This effect is illustrated in FIGS. 2*a*-2*c* and discussed in further detail below.

The skilled man will appreciate that so long as the printed image layer 12 is provided in front of the diffusion layer 13 and the blocking layer 14, there are multiple options for arranging the layers. By way of example only, some possible alternative arrangements are described below. It should be appreciated that the teaching of some of these examples might readily be combined by the skilled man.

FIG. 1*b* shows a printed display wherein the diffusion layer 13 is only provided in the areas not backed by the blocking layer 14. This arrangement is feasible where the blocking layer is a metallised layer.

FIG. 1*c* shows a printed display wherein a further diffusion layer 13*b* is provided behind the blocking layer 14. The further diffusion layer 13*b*, allows diffuse reflection of light incident on the areas of the display 10 backed by the blocking layer 14. Such reflected light has an opportunity to subsequently reflect onto the areas of the display 10 which are not backed by the blocking layer 14. This can increase the effective highlighting of these areas for a given level of illumination.

FIG. 1*d* shows a printed display where the substrate 10 itself forms the diffusion layer 13. This might be the case where the substrate 11 is paper or tinted plastic.

FIG. 1*e* shows a display 10 wherein the printed image layer 12 and the diffusion layer 13 are formed on one side of the substrate wherein the blocking layer 14 is formed on the other side of the substrate 11. Figure if shows a display 10 wherein the printed image layer 12 is formed on one side of the substrate 11 wherein diffusion layer 13 and the blocking layer 14 are formed on the other side of the substrate 11.

FIG. 1*g* shows a display 10 comprising two layers of substrate 11. Upon the rear of the front substrate layer is formed the printed image layer 12 and the diffusion layer 13. Upon the rear of the rear substrate layer is formed the blocking layer 14. This arrangement can provide for a stronger display and provide additional protection for the printed image layer 12. This arrangement is also suitable where the blocking layer 14 is a metallised layer. In particular, this construction facilitates forming the blocking layer 14 by taking a metallised film and removing parts of the metallised layer as required. The skilled man will appreciate that in variations on this embodiment additional layers of substrate 11 may be provided between the diffusion layer 13 and the blocking layer 14 or behind the blocking layer 14.

In further implementations, the skilled man will appreciate that different areas of the blocking layer 14 can be formed from material operable to block the passage of specific colours. This might be achieved by forming the blocking layer 14 from areas of different coloured inks. This can then allow the appearance of the display to be varied dependent upon the colour of rear illumination as well as the presence or absence of rear illumination.

FIG. 2*a*, shows the printed image layer 12 of a display 10 under front lighting, when the balloon is lit from its outside. The image 20 comprises a FIG. 21 standing in a desert 22, with sun 23 and clouds 24 in the sky 25 above. The blocking layer 14 behind the printed image layer 12 is shown in FIG. 2*b*. The blocking layer 14 does not back the FIG. 21 or the desert 22. The blocking layer 14 fully backs the sky 25. The blocking layer 14 partially backs the sun 23, leaving a crescent moon shape 27 uncovered. Similarly, the clouds 24 are only partially backed by the blocking layer 14, leaving multiple stars 28. As a result when the balloon is lit from its inside, the image 20 is backlit and the blocking layer 14 blocks illumination of the sky 25 and partially blocks illumination of the sun 23 and the clouds 24. The image 20 of the printed image layer 12 therefore takes on the appearance shown in FIG. 2*c*, wherein the moon 27 and stars 28 can be seen highlighted as can the internal details (face and body texture) of the FIG. 21 and desert 22 (sand texture).

Turing now to FIG. 3, an illuminated, self-sealing, non-latex balloon 100 comprises a first balloon sheet 110 and a second balloon sheet 112 which are bonded together, typically by heat sealing prior to or at substantially the same time as cutting to shape, around their periphery to define a body 114 and a stem 116. A more detailed description of the construction balloons of this type is contained in GB2472785, the relevant contents of which are incorporated by reference.

The balloon sheets 110, 112 are made of suitable heat-sealable material, such as MYLAR®, polyethylene or a laminate of polyethylene and nylon. One or both sheets 110, 112 comprises a substrate 11 for forming a printed display according to the present invention. Such sheets 110, 112 are printed with an image layer 12, diffusion layer 13 and blocking layer 14 as described above. Typically, said sheets 110, 112 are printed with each layer 12, 13, 14 on their interior side. This reduces the prospect of contact damage to the image after manufacture. In a preferred embodiment, there is an additional diffusion layer 13*b* printed behind the blocking layer 14.

During the production process, a self-sealing valve 120 is inserted between the first and second balloon sheets 110, 112. The balloon is inflated by insertion of a nozzle into the stem 116 and into the inlet 123 so that a gas such as air, or preferably helium, is supplied into the body of the balloon via valve 120.

A small electronic unit 104 incorporating an illumination source in the form of a light emitting diode (LED) 140 is mounted into a balloon of the type just described at a location where the stem 116 merges into the body 114, thus at the same location as where the valve 120 is sealed into position. The electronic unit 104 comprises a housing to which the LED 140 is mounted, said housing enclosing batteries 141, disposed side-by-side, to which the LED 140 is connectable by conventional electric circuit means. However, a removable tab 108, comprising an elongate strip of plastics material or card or any other suitable non-conducting material is inserted into the unit 104 to prevent connection between the batteries 141 and the LED 140, so the LED 140 will only be illuminated by completion of the electric circuit when this tab 108 is pulled out. The tab 108 has an enlarged outer end region in the form of an arrowhead 148. As shown in FIG. 4, the tab 108 has an additional enlarged region 145, in this case of generally rounded form, at a spacing from the arrowhead 148. In another modified version, in place of the tab 108, a displaceable switch may be provided which would not be removable but would allow the LED 141 to be switched off and on.

When the LED 141 is switched off, any illumination of the balloon 100 is provided externally. Accordingly, on the outer surface of the balloon 100, one would see the image printed in the image layer 12. When the LED 141 is switched on, and the illumination provided by the LED 141 is rather greater than that provided by any external source, the illumination is primarily internal to the balloon 100. Internal illumination is blocked from transmission through the sheets 110, 112 by the blocking layer 14. Accordingly, on the outer surface of the balloon 100, one would see the areas of the image layer 12 not backed by the blocking layer 14 highlighted, whilst the remaining areas of the image layer appear substantially black. The balloon 100 can therefore take on a markedly different appearance under internal illumination to under external illumination.

To improve the efficiency of internal illumination, a further diffusion layer 13*b* may be provided inside the blocking layer 14. This further diffusion layer acts to reflect light within the interior of the balloon, causing some light that would otherwise be absorbed by the blocking layer to be scattered and ultimately illuminate the image layer 12 from behind. The scattering provided by further diffusion layer 13*b* also improves the evenness of illumination across the whole balloon surface.

The above embodiments are described by way of example only. Many variations are possible without departing from the scope of the invention as defined in the appended claims.

The invention claimed is:

1. A balloon comprising a printed display, the printed display comprising: a printed image layer; a blocking layer provided behind selected portions of the printed image layer; and a diffusion layer provided behind at least those portions of the printed image layer not backed by the blocking layer, wherein the blocking layer acts to block illumination of the selected portions of the printed image layer when the balloon is lit primarily from its inside, such that the portions of the printed image layer not backed by the blocking layer are highlighted when the balloon is lit primarily from its inside so as to provide a different external appearance to when the balloon is lit primarily from its outside.

2. The balloon as claimed in claim 1 wherein the printed display comprises a transparent or translucent substrate upon which one or more of the layers are printed.

3. The balloon as claimed in claim 2 wherein if the substrate is translucent, the substrate comprises the diffusion layer.

4. The balloon as claimed in claim 2 wherein the substrate comprises multiple layers laminated directly to one another.

5. The balloon as claimed in claim 4 wherein the printed image layer, diffusion layer and/or the blocking layer are provided on different substrate layers or between substrate layers.

6. The balloon as claimed in claim 2 wherein the printed image layer is provided on the rear side of the substrate.

7. The balloon as claimed in claim 2 wherein if the printed image layer is provided on the front side of the substrate, the diffusion layer and/or the blocking layer are provided on either the front side or the rear side of the substrate.

8. The balloon as claimed in claim 2 wherein the printed image layer comprises one or more layers of a single ink or multiple different coloured inks.

9. The balloon as claimed in claim 2 wherein the diffusion layer comprises one or more layers of white or substantially white ink.

10. The balloon as claimed in claim 2 wherein the blocking layer may comprise one or more layers of dark, black or substantially black ink or a layer of metallic foil.

11. The balloon as claimed in claim 2 wherein the display comprises an additional diffusion layer provided behind the blocking layer.

12. The balloon as claimed in claim 2, further comprising an illumination source that is operable to illuminate the inside of the balloon.

13. The balloon according to claim 12 wherein the illumination source comprises any one or more of: a single monochrome illumination source; multiple different coloured monochrome illumination sources; or a substantially white illumination source.

14. The balloon according to claim 12 wherein the illumination source is operable to provide: substantially steady illumination, smoothly varying illumination, or intermittent illumination.

15. The balloon according to claim 12 wherein the illumination source is operable in response to an illumination controller.

16. The balloon according to claim 15 wherein the illumination controller comprises a switch.

17. The balloon according to claim 15 wherein the illumination controller comprises a processing unit operable to control the operation of the illumination source in response to specified control signals.

18. The balloon according to claim 17 wherein the control signals are generated by: a communication receiving unit operable to receive control signals from external devices; a timer unit; or one or more sensing units operable to sense: ambient light levels; temperature; air pressure; moisture; or ambient noise levels.

19. The balloon according to claim 2 wherein the balloon comprises a non-latex body and a stem comprising, in combination: a first balloon sheet having an interior surface and a periphery; a second balloon sheet bonded to the periphery of the interior surface of the first balloon sheet so as to define the body and the stem; and an illumination source located in or adjacent the stem of the balloon; and wherein the first balloon sheet and/or the second balloon sheet comprises the printed display.

20. The balloon according to claim 19 wherein the illumination source controller comprises a displaceable actuator located in or adjacent the stem of the balloon.

21. The balloon according to claim 20 wherein the displaceable actuator comprises a removable tab initially located between said illumination source and the power supply, removal of which serves to activate the illumination source by connection to its power supply.

22. The balloon according to claim 20 wherein the displaceable actuator comprises a switch initially located between said illumination source and the power supply, displacement of which serves to activate the illumination source by connection to its power source.

23. A method of manufacturing a printed display for a balloon according to claim 1, the method comprising the steps of: printing the image layer, diffusion layer and blocking layer in turn on a substrate such that the blocking layer is provided behind selected portions of the printed image layer and the diffusion layer is provided behind at least those portions of the printed image layer not backed by the blocking layer.

24. The method of claim 23 wherein the method includes the steps of printing the blocking layer over the full area of the display and subsequently removing areas of the printed blocking layer.

25. A method of manufacturing a printed display for a balloon according to claim 1, the method comprising the steps of: printing the image layer, diffusion layer and blocking layer in turn on different layers of substrate; and bonding the layers of substrate together such that the blocking layer is provided behind selected portions of the image layer and the diffusion layer is provided behind at least those portions of the printed image layer not backed by the blocking layer.

26. The method of claim 25 wherein the method includes the steps of printing the blocking layer over the full area of the display and subsequently removing areas of the printed blocking layer.

* * * * *